United States Patent [19]

Coker

[11] Patent Number: 4,796,596

[45] Date of Patent: Jan. 10, 1989

[54] FUEL SAVING METHOD AND DEVICE FOR INTERNAL COMBUSTION ENGINES

[76] Inventor: Wesley F. Coker, 615 Vance Jackson, Apt. 208, San Antonio, Tex. 78201

[21] Appl. No.: 93,815

[22] Filed: Sep. 8, 1987

Related U.S. Application Data

[63] Continuation-in-part of Ser. No. 899,881, Aug. 25, 1986, abandoned.

[51] Int. Cl.[4] ..... F02M 29/04

[52] U.S. Cl. ..... 123/593; 48/189.6

[58] Field of Search ..... 123/590, 593; 48/180.1, 48/189.4, 189.6

[56] References Cited

U.S. PATENT DOCUMENTS

| | | | |
|---|---|---|---|
| 1,542,933 | 6/1925 | Gepfert et al. | 48/189.6 |
| 1,620,410 | 3/1927 | Tansill | 48/189.6 |
| 2,259,014 | 10/1941 | Upperman | 48/189.4 |
| 4,375,801 | 3/1983 | Eckman | 123/590 |
| 4,384,563 | 5/1983 | Siefer et al. | 123/593 |
| 4,415,507 | 11/1983 | Voliva | 123/593 |

FOREIGN PATENT DOCUMENTS

| | | | |
|---|---|---|---|
| 195251 | 4/1967 | U.S.S.R. | 123/593 |

*Primary Examiner*—E. Rollins Cross

*Attorney, Agent, or Firm*—Joseph W. Farley

[57] ABSTRACT

A fuel saving device comprising a chamber formed within a housing adapted to be mounted between the carburetor and the intake manifold of an internal combustion engine, the chamber having an inlet end opening which registers with the discharge passage of the carburetor and receives a fuel-air mixture formed in the carburetor, and an outlet end opening which connects to the intake manifold. Micro-porous filter plates are mounted in the chamber transversely to the path of flow of the fuel-air mixture, are spaced from each other in the direction of flow, and a bypass passage is associated with some of the filter plates. Increased vaporization of the fuel results from the flow of the fuel-air mixture around and through the filter plates with the result that the fuel quantity can be reduced, fuel economy improved, and exhaust emissions decreased.

27 Claims, 4 Drawing Sheets

FUEL SAVING METHOD AND DEVICE FOR INTERNAL COMBUSTION ENGINES

This is a continuation-in-part of copending application Ser. No. 06/899,881 filed on Aug. 25, 1986 now abandoned.

SUMMARY OF THE INVENTION

This invention relates to a device for improving the combustibility of a fuel-air mixture formed in a carburetor of an internal combustion engine.

In general, the device of the invention is located at the downstream or discharge end of a carburetor, receives a fuel-air mixture formed therein, and enhances that mixture by increasing the physical mixing of the fuel and air and by increasing the vaporization of the fuel in the air.

Thus, when the enhanced fuel-air mixture is drawn into a cylinder of the engine and ignited, a more complete combustion of the fuel takes place. A significant reduction is thereby achieved in the amount of fuel required to operate an engine of given size, together with a consequent reduction in the exhaust pollution produced by the engine.

In the description of the invention to follow, it will be understood that the term "intake manifold" applies to the passage or passages leading from the carburetor to the cylinders or cylinders of an internal combustion engine.

A fuel saving device of the invention comprises a housing adapted to be interposed between a carburetor and an intake manifold of an internal combustion engine. A chamber formed within the housing has an inlet end opening adapted to register with the discharge passage of the carburetor and receive a fuel-air mixture formed therein. An outlet end opening of the chamber is adapted to connect to the intake manifold. Micro-porous filter means are carried by the housing within the chamber, are disposed in the path of flow through the chamber of a least a portion of the fuel-air mixture, and are adapted to permit the flow of the mixture therethrough with consequent mixing of the fuel and air, together with increased vaporization of the fuel.

Preferably, the filter means comprises a plurality of micro-porous filter plates extending transversely to the path of flow of the fuel-air mixture through the chamber and disposed successively in the path of flow. Associated with at least one of the filter plates is a passage which permits the by-pass flow of a portion of the fuel-air mixture. For example, the filter plate means may comprise first, second, third and fourth successive filter plates, the first and fourth filter plates having a porosity range of 50 to 130 microns and the second and third filter plates having a porosity range of 25 to 50 microns. The filter plates are spaced from each other longitudinally, or in the path of flow.

Other preferred features are that the chamber is formed with a transverse cross-sectional area which progressively increases from the cross-section area which of the inlet end opening to a maximum cross-sectional area at a location between the inlet and outlet end openings; that the housing is a two-piece structure comprising an inlet end portion and an outlet end portion formed with mating surfaces which abut at the maximum cross-sectional area of the chamber; that one of the filter plates has a peripheral portion mounted in a recess formed in the mating surface of one of the housing portions; and, that the passage associated with a filter plate for permitting the by-pass flow of a portion of the fuel-air mixture is arranged peripherally of that filter plate.

Other features and advantages of the invention will appear from the description to follow of the embodiments shown in the accompanying drawings.

DETAILED DESCRIPTION

Figure 1:
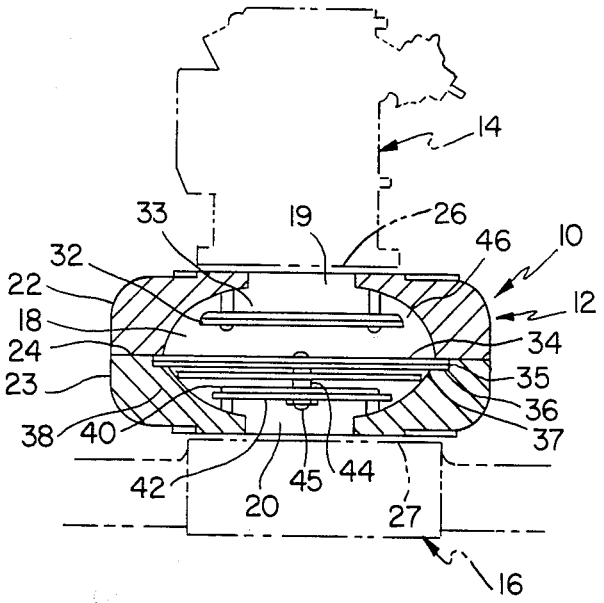
FIG. 1 is a sectional elevation taken through a fuel saving device constructed in accordance with the invention and showing the relationship of the device to a carburetor and intake manifold, indicated in broken line, of an internal combustion engine.
Figure 2:
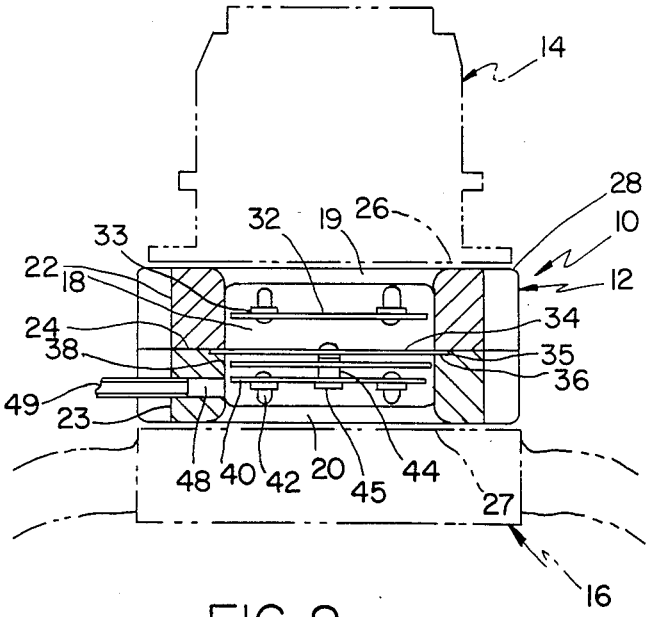
FIG. 2 is a sectional elevation taken normal to the section of FIG. 1.

As shown in FIGS. 1 and 2, a fuel saving device 10 of the invention comprises a housing 12 adapted to be interposed between a conventional carburetor 14 and intake manifold 16 of an internal combustion engine (not shown). Formed within the housing 12 is a chamber 18 having an inlet end opening 19 and an outlet end opening 20. The inlet end opening 19 is adapted to register with the discharge passage of the carburetor and receive a fuel-air mixture formed therein; the outlet end opening 20 is adapted to connect with the manifold 16 and deliver the mixture thereto in enhanced form.

The housing 12 is a two-piece structure comprising an inlet end part 22 and an outlet end part 23 formed with mating surfaces 24 that abut, the parts 22 and 23 having internal configurations such that the chamber 18 has a cross-sectional area which progressively increases (as shown in FIG. 1) from the cross-sectional area of the inlet end opening 19 to a maximum cross-sectional area intermediate the inlet and outlet end openings 19 and 20 and at the location of the abutting surfaces 24. It will be understood that the housing 12 has an external configuration adapted to mate with the opposed surfaces 26 of the carburetor 14 and 27 of the manifold 16; and has corner bosses 28 (FIG. 2) provided with suitable means for connecting the housing parts 22 and 23 together and for mounting the housing 12 between the carburetor 14 and the manifold 16.

Micro-porous filter plate means are carried by the housing 12 and are mounted within the chamber 18 for enhancing the combustibility of the fuel-air mixture formed in the carburetor 14. In the particular fuel saving device 10 illustrated, the filter plate means comprise a first filter plate 32 attached to support pads 33 formed with the inlet end part 22 of the housing; a second filter plate 34 having a peripheral portion 35 mounted in a recess 36 formed in one of the abutting surfaces 24 and centrally supported by a transverse bar 37; a third filter plate 38; and, a fourth filter plate 40 attached to support pads 42 formed with the outlet end part 23 of the housing 12, the third filter plate 38 being positioned by spacers 44 on a bolt 45 extending through the second, third and fourth plates as best shown in FIG. 2.

The filter plates 32, 34, 38 and 40 extend transversely to the path of flow of the fuel-air mixture between the carburetor 14 and the manifold 16, and associated with each of the first, third and fourth filter plates ia a passage means for permitting the by-pass flow of a portion of the fuel-air mixture, each passage means being formed by a gap 46 between the periphery of its plate and the adjacent wall of the chamber 18.

Each of the filter plates 32, 34, 38 and 40 is formed of a micro-porous material. A "micro-porous material" for purposes of the invention described and claimed herein, is a material through which the fuel-air mixture can flow; or, in other words, a material having fine holes each of which forms an orifice. One example of such a micro-porous material is a sintered bronze filter made by Pacific Sintered Metals Co. of Los Angeles, Calif., in varying degrees of porosity. For example, the first plate 32 may have a porosity range of 50 to 130 microns, the second and third plates 34 and 38 a porosity range of 25–50 microns, and the fourth plate 40 a porosity range of 50–130 microns.

It is presently believed that the successive plates should preferably be spaced apart from each other longitudinally, or in the general direction of flow of the fuel-air mixture, as shown, thus dividing the chamber 18 into a plurality of sub-chambers in each of which mixing of the fuel and air and vaporization of the fuel takes place.

Provided in the outlet end part 23 of the housing 12 is an opening 48 (FIG. 2) for a conventional crankcase ventilation connection 49, the opening being located at the downstream side of the fourth plate 40 so that crankcase contaminants do not foul any of the plates.

Figure 3:
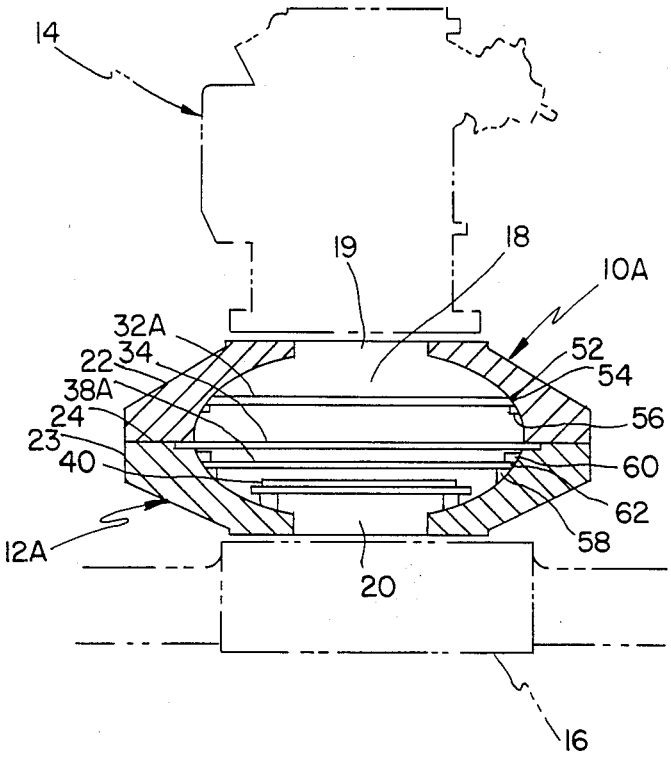
FIG. 3 is a sectional elevation similar to FIG. 1 showing a modified form of the device of the invention; and, FIG. 4 is a sectional elevation taken normal to the section of FIG. 3.
Figure 4:
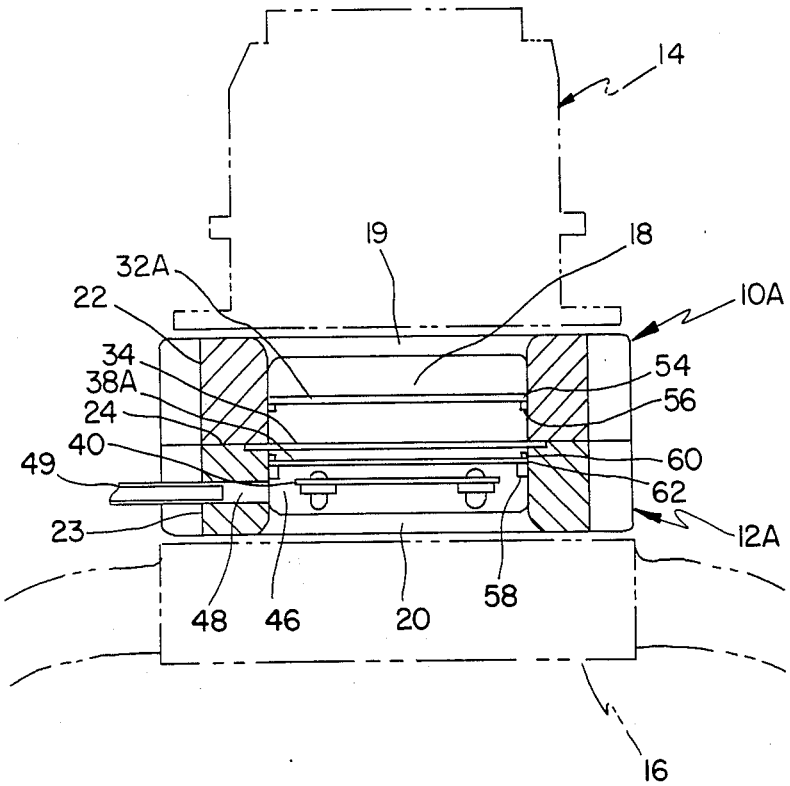

FIGS. 3 and 4 show a modified device 10A that is essentially the same as the device 10 and corresponding reference numerals have been used for corresponding components. Mounted within the housing 12A are four successive micro-porous filter plates 32A, 34, 38A and 40 which may be identical in material and porosity range to the corresponding plates of the device 10. The second or intermediate plate 34 is mounted between the abutting surfaces 24 of the housing inlet end portion 22 and outlet end portion 23 and extends over the entire cross-sectional area of the chamber 18 at the plane of the abutting surfaces 24. Each of the first plate 32A and the third plate 38A, which respectfully precede and succeed the intermediate plate 34 in the direction of flow of the fuel-air mixture, is positioned within the chamber 18 by mounting means engaging the entire peripheral portion of the plate. No passage is associated with either of the plates 32A or 38A for permitting the by-pass flow of any portion of the fuel-air mixture.

For the first plate 32A, the mounting means comprises a recessed ledge 52 (FIG. 3) formed in the walls of the chamber 18 and engaged by the peripheral portion 54 of the plate 32A. A retainer 56, which may be of segmented construction, is detachably secured to the chamber walls by suitable means such as screws (not shown). In assembling the first plate 32A within the housing with the inlet and outlet end portions 22 and 23 separated, the retainer 56 is removed, a seal or liquid sealant is preferably applied around the peripheral portion 54 of the plate 32A which is then positioned in engagement with the ledge 52, and the retainer 56 is attached to the housing portion 22.

The mounting means for the third plate 38A comprises a projecting seat or ledge 58 formed on the walls of the chamber 18, and a removable retainer or seal 60. The plate 38A is positioned within the housing outlet end portion 23 of the chamber with the entire peripheral portion 62 of the plate engaging the seat 58, the seal 60 is then inserted into engagement with the portion 62 of the plate and is suitably secured to the housing portion 22.

The fourth filter plate 40 is mounted in the same manner as is the corresponding plate in the device 10 of FIGS. 1 and 2, by being attached to support pads 42 with screws (not shown) No spacers 44 are required, thus increasing the effective area of the filter plates. In case of an engine backfire, the fourth filter plate 40 acts to protect the upstream filter plates from damage.

An experimental device 10 and an experimental device 10A, each constructed substantially as shown and described and provided with four sintered bronze micro-porous filter plates having the porosity ranges specified above, have each been tested on a 1977 Mercury automobile equipped with a 400 cubic inch V-8 engine by installing the device between the standard carburetor and intake manifold of that engine. With each device it was found that the size of the carburetor metering jets could be reduced considerably, and that a greater reduction in metering jet size was possible with the experimental device 10A. In either case, the amount of fuel supplied by the carburetor was reduced and the resulting fuel-air mixture formed was a lean mixture.

Comparative mileage and exhaust emission test results obtained from the experimental device 10A are tabulated below. The column headed STANDARD gives the results with the standard carburetor-intake manifold arrangement of the 400 cubic inch V-8 engine and with standard size No. 62 metering jets installed in the carburetor. The column headed MODIFIED gives the results obtained with the experimental device 10A installed between the carburetor and intake manifold and with the size No. 62 metering jets replaced by size No. 36 metering jets. All emission tests were conducted without a catalytic converter in the exhaust system.

| | STANDARD | MODIFIED |
|---|---|---|
| Mileage | | |
| At 30–40 M.P.H. | 6.2 M.P.G. | 16.4 M.P.G. |
| At 50–55 M.P.H. | 9.4 M.P.G. | 19.5 M.P.G. |
| Emissions | | |
| Hydrocarbon | 1411 PPM | 68 PPM |
| Carbon Monoxide | 7.14% | .19% |

These results are given as indicative of the reductions in fuel consumption and exhaust emissions attainable from the device of the invention and show that it improves or enhances the combustibility of a fuel-air mixture. Exhaust gas emissions, as determined by standard certification tests for hydrocarbons and carbon monoxide, can be reduced below allowable specifications without a catalytic converter.

It is presently believed that the enhanced combustibility is achieved by one or more of the following actions on the fuel-air mixture during its passage through the mixing chamber of the device and through and around the plates provided therein.

1. The time for the fuel and air to mix is extended.

2. The physical mixing of the fuel and air is increased by the flow of the mixture across and through the plates.

3. The fuel particle size is reduced, or in other words vaporization of the fuel is increased, by the passage of the fuel through the fine pores of the plates. Increased vaporization is also believed to result from pressure drops in the mixture caused by the plates and by the increasing cross-sectional area of the chamber 18. An indication of increased vaporization is that the housing 12 is cool to the touch even after an extended period of engine operation.

It will be appreciated by persons skilled in the art that the particular constructions of the device shown and described herein are only representative of the invention. The size and configuration of the housing 12 will have to be varied to suit the carburetor and manifold of each specific engine. In fact, the device could conceivably be constructed integrally with a carburetor, although the separate type of housing 12 disclosed is believed to be preferable for ease of cleaning, if and when necessary. Also, the number of filter plates used in a particular design of the device, as well as their porosity, may be varied, as desired and described above.

I claim:

1. A fuel saving device comprising a housing adapted to be interposed between a carburetor and an intake manifold of an internal combustion engine; a chamber formed within said housing, said chamber having an inlet end opening adapted to register with a discharge passage of said carburetor and receive fuel-air mixture formed in said carburetor, and said chamber having an outlet end opening adapted to connect to said intake manifold; characterized by micro-porous filter means mounted within said chamber and extending transversely to the path of flow of said fuel-air mixture between said inlet and outlet end openings, said filter means being formed at least in part by a micro-porous filter plate adapted to permit the flow therethrough of the fuel-air mixture received from said carburetor.

2. A fuel saving device according to claim 1 wherein said filter means comrpises a plurality of micro-porous filter plates arranged successively in the path of flow of said fuel-air mixture between said inlet and outlet end openings.

3. A fuel saving device according to claim 2 wherein filter plate mounting means are provided on the walls of said chamber, said mounting means being engageable by the entire periphery of at least certain of said filter plates.

4. A fuel saving device according to claim 3 wherein sealing means are provided at the periphery of at least said certain of said filter plates.

5. A fuel saving device according to claim 2 further comprising passage means associated with at least one of said filter plates for permitting the by-pass flow of a portion of said fuel-air mixture.

6. A fuel saving device according to claim 5 wherein said passage means comprises a gap between the walls of said chamber and the periphery of the last of said successively arranged filter plates in the direction of flow of said fuel-air mixture.

7. A fuel saving device according to claim 2 wherein said chamber is formed with a transverse cross-sectional area which progressively increases from the cross-sectional area of said inlet end opening to a maximum cross-sectional area intermediate said inlet and outlet end openings, and one of said filter plates is mounted at said maximum cross-sectional area.

8. A fuel saving device according to claim 7 wherein said housing is a two part structure comprising an inlet end portion and an outlet end portion, said portions being formed with mating surfaces which abut at said maximum cross-sectional area of said chamber.

9. A fuel saving device according to claim 8 wherein a recess is formed in the mating surface of one of said housing portions, and said one of said filter plates has a peripheral portion mounted within said recess.

10. A fuel saving device according to claim 7 wherein said one filter plate mounted at said maximum cross-sectional area is an intermediate filter plate extending entirely over said maximum cross-sectional area, said plurality of filter plates include a preceding filter plate and a succeeding filter plate respectively positioned in said chamber upstream and downstream of said intermediate filter plate in the path of flow of said fuel-air mixture, and mounting means on the walls of said chamber for engaging the entire periphery of each of said preceding and succeeding filter plates.

11. A fuel saving device according to claim 10 wherein said mounting means includes means for sealing the periphery of each of said preceding and succeeding filter plates relative to said housing.

12. A fuel saving device according to claim 11 wherein said preceding filter plate has a pore size greater than the pore size of at least one of said intermediate and succeeding filter plates

13. A fuel saving device according to claim 12 wherein said successively arranged transversely extending filter plates are spaced from each other longitudinally in the direction of flow of said fuel-air mixture.

14. A fuel saving device according to claim 13 wherein said housing is provided at the downstream side of said filter plates with an opening for a crankcase ventilation connection for said engine.

15. A fuel saving device according to claim 2 wherein at least one of said successively arranged micro-porous filter plates has a pore size which is smaller than the pore size of a preceding filter plate.

16. A fuel saving device according to claim 2 wherein the pore size of said successively arranged micro-porous filter plates progressively decreases and increases.

17. A fuel saving device according to claim 2 wherein said successively arranged micro-porous filter plates include adjacent upstream and downstream filter plates, said upstream filter plate being located closer to said inlet opening than said downstream filter plate and having a pore size greater than the pore size of said downstream filter plate.

18. A fuel saving device for use with a carburetor having a discharge passage for a fuel-air mixture formed in the carburetor and delivered to an intake manifold of an internal combustion engine, said device comprising housing means for defining a chamber having an inlet forming an extension of said discharge passage and having an outlet adapted to be connected to said intake manifold; characterized by micro-porous filter plate means carried by said housing within said chamber for enhancing the combustibility of said fuel-air mixture, said filter plate means being disposed in the path of flow through said chamber of at least a portion of said fuel-air mixture.

19. A fuel saving device according to claim 18 wherein said chamber is formed with a transverse cross-sectional area which progressively increases from the cross-sectional area of said discharge passage to a maximum cross-sectional area at a location between said inlet and outlet, and said micro-porous filter plate means is disposed at least in part in said progressively increasing cross-sectional area.

20. A fuel saving device according to claim 18 wherein said filter plate means comprises a plurality of filter plates disposed successively in the path of flow of said fuel air-mixture, said filter plates being spaced from each other in the direction of flow of said fuel-air mixture.

21. A fuel saving device according to claim 20 wherein the first of said plurality of filter plates is disposed at the upstream portion of the path of flow of said fuel-air mixture and has a pore size greater than the pore size of a downstream one of said filter plates.

22. A fuel saving device according to claim 21 wherein said first of said plurality of filter plates has a porosity range of 50 to 130 microns, and is disposed on the upstream side of at least one filter plate having a porosity range of 25 to 50 microns.

23. A fuel saving device according to claim 21 wherein the last of said plurality of filter plates is disposed at the downstream portion of said path of flow and has a pore size greater than the pore size of an upstream one of said filter plates.

24. A fuel saving device according to claim 23 wherein said last filter plate has associated therewith means for providing a by-pass flow for a portion of said fuel-air mixture.

25. A fuel saving device according to claim 20 wherein said housing means is provided at the downstream side of said plurality of filter plates with an opening for a crankcase ventilation connection for said engine.

26. The method of reducing the exhaust pollution produced by an internal combustion engine having a passage through which fuel flows for ignition as a fuel-air mixture in said engine comprising the steps of:

installing in said passage a micro-porous filter means in a manner such that the fuel must flow therethrough; and reducing the flow of fuel through said passage to an amount such that said fuel-air mixture is a lean mixture.

27. The method of reducing the fuel consumption of and exhaust pollution produced by an internal combustion engine having a carburetor within which a fuel-air mixture is formed and delivered through a discharge passage to an intake manifold of said engine, said method comprising the steps of:

installing a micro-porous filter means in the path of flow of said fuel-air mixture through said discharge passage, and reducing the amount of fuel metered by said carburetor such that the fuel-air mixture formed therein is a lean mixture.

* * * * *